US009442444B2

(12) United States Patent
Hamada

(10) Patent No.: US 9,442,444 B2
(45) Date of Patent: Sep. 13, 2016

(54) FIXING DEVICE AND IMAGE FORMING APPARATUS

(71) Applicant: KYOCERA Document Solutions Inc., Osaka (JP)

(72) Inventor: Toshiyuki Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/014,067

(22) Filed: Feb. 3, 2016

(65) Prior Publication Data

US 2016/0223970 A1 Aug. 4, 2016

(30) Foreign Application Priority Data

Feb. 4, 2015 (JP) ..... 2015-020140

(51) Int. Cl.
*G03G 15/20* (2006.01)

(52) U.S. Cl.
CPC ..... *G03G 15/2085* (2013.01); *G03G 15/2028* (2013.01)

(58) Field of Classification Search
CPC ..... G03G 15/2028; G03G 15/2085; G03G 15/6532
USPC ..... 399/67, 68, 323, 398, 399
See application file for complete search history.

(56) References Cited

U.S. PATENT DOCUMENTS

| | | | | |
|---|---|---|---|---|
| 5,017,970 | A * | 5/1991 | Sakata | G03G 15/2028 399/677 X |
| 9,069,298 | B2 * | 6/2015 | Mikutsu | G03G 15/2028 |
| 2012/0224893 | A1 * | 9/2012 | Yamamoto | G03G 15/2028 399/323 |
| 2015/0309455 | A1 * | 10/2015 | Matsumoto | G03G 15/2085 399/323 |
| 2016/0026140 | A1 * | 1/2016 | Oomoto | G03G 15/2028 399/323 |

FOREIGN PATENT DOCUMENTS

JP 2010-256926 A 11/2010

* cited by examiner

*Primary Examiner* — Sophia S Chen
(74) *Attorney, Agent, or Firm* — Studebaker & Brackett PC

(57) ABSTRACT

In a fixing device, on a receiving surface of a separating plate provided at a downstream side of a nip part formed between the fixing roller and the pressing roller, a catch part is formed in an edge part facing the nip part. When a direction of a sheet ejected from the nip part comes close to the fixing roller, a front end part of the sheet is caught by the catch part, and the sheet is largely bent or leaps up. A position detector detects the bending or leaping up of the sheet and recognizes that the direction of the sheet ejected from the nip part comes close to the fixing roller. The controller decreases force for pressing the fixing roller and the pressing roller or a fixing temperature, whereby the direction of the sheet ejected from the nip part is deviated from the fixing roller.

7 Claims, 7 Drawing Sheets

FIXING DEVICE AND IMAGE FORMING APPARATUS

INCORPORATION BY REFERENCE

This application is based on and claims the benefit of priority from Japanese Patent application No. 2015-020140 filed on Feb. 4, 2015, the entire contents of which are incorporated herein by reference.

BACKGROUND

The present disclosure relates to a fixing device used for an electrographic image forming apparatus, and an electrographic image forming apparatus.

The electrographic image forming apparatus includes a fixing device configured to fix a toner image transferred from a photosensitive drum onto a sheet. In the fixing device, a pressing roller is pressed onto a fixing roller heated by a heat source such as a halogen heater, the sheet passes through a nip part formed between the fixing roller and the pressing roller, and the toner image formed on the sheet is heated and pressurized, thereby being fixed on the sheet. It is to be noted that, in recent years, instead of the fixing roller, a fixing device using an endless fixing belt has also been developed.

In such a fixing device, when a sheet on which a toner image is formed passes through the nip part, there is a tendency that the sheet winds on a circumference face of the fixing roller due to viscosity of melted toner. In order to prevent such a winding of the sheet onto the fixing roller, in the fixing device, a separating plate for separating the sheet that passed through the nip part from the circumference face of the fixing roller is provided. The separating plate is formed in a rectangular plate, and is placed at a downstream side of the nip part. Long sides of the separating plate extends in parallel with an axis of the fixing roller and short sides of the separating plate extends in a sheet conveyance direction. In addition, in the separating plate, an edge part facing the nip part is extremely close to the circumference face of the fixing roller, but is not in contact with the circumference face of the fixing roller, and is apart from the circumference face of the fixing roller at a predetermined distance.

As described above, in the fixing device, the fixing roller and the pressing roller are pressed one another. The circumference face of the pressing roller is pressed by the fixing roller and is subject to elastic deformation partially in a recessed shape. Apart between a part that presses the pressing roller in the fixing roller and a part that is pressed by the fixing roller and is subject to elastic deformation partially in a recessed shape in the pressing roller corresponds to the nip part. It is to be noted that, among types of the fixing devices, there is a fixing device in which the fixing roller (not pressing roller) is subject to elastic deformation in a recessed shape and a fixing device in which both of the fixing roller and the pressing roller are subject to elastic deformation. However, here, a case where the pressing roller is subject to elastic deformation in a recessed shape is exemplified.

When the force for pressing the fixing roller and the pressing roller one another increases, the degree that the fixing roller eats into the pressing roller increases, and the degree that the pressing roller is subject to elastic deformation in a recessed shape increases. As a result, the length of the nip part in the sheet conveyance direction is lengthened. When the nip part is lengthened, the degree that the sheet that passes through the nip part is curved along a recessed shape of the nip part is enlarged, and the ejecting direction of the sheet that is ejected from the nip part comes close to the circumference face of the fixing roller.

When the degree that the ejecting direction of the sheet that is ejected from the nip part comes close to the circumference face of the fixing roller is enlarged, the end part of the sheet that is ejected from the nip part comes into contact with an end surface facing the nip part in the separating plate and is largely bent, and then, the sheet is sometimes out of the conveying path. As a result, jamming is sometimes caused inside the fixing device.

Accordingly, in the fixing device, while considering stability of fixing of a toner image, in order to prevent the ejecting direction of the sheet that is ejected from the nip part from coming close to the circumference face of the fixing roller, the force for pressing the fixing roller and the pressing roller one another is appropriately set, thereby ensuring an appropriate length of the nip part.

However, depending on the usage, such as a case where a long-time continuous printing is carried out, of the image forming apparatus, in use, the hardness of the pressing roller is decreased. As a result, the pressing roller is pressed by the fixing roller, the degree that the pressing roller is subject to elastic deformation in a recessed shape increases, and the nip part is lengthened. In addition, when the nip part is lengthened, the degree that the ejecting direction of the sheet that is ejected from the nip part comes close to the circumference face of the fixing roller increases, and thus there is an increased risk that jamming is caused inside the fixing device.

In order to prevent such a generation of jamming, in a fixing device or an image forming apparatus, it is favorable that, for example, an increase of degree that the ejecting direction of the sheet ejected from the nip part comes close to the circumference face of the fixing roller is recognized, and control for avoiding a generation of jamming is automatically carried out based on the recognition.

However, the degree that the ejecting direction of the sheet ejected from the nip part comes close to the fixing roller less changes, and therefore, the change cannot be easily recognized.

On this point, a technique is known in which an abnormal trace of the sheet is detected by a transmission optical sensor that allows light to be transmitted toward the axis direction at the downstream side of the fixing roller. However, it is difficult to detect a small change of the ejecting direction of the sheet ejected from the nip part by this technique.

It is to be noted that, immediately before generation of the jamming in the fixing device, the sheet begins to be congested at the downstream side of the fixing roller, the trace of the sheet ejected from the nip part largely changes. According to the above-mentioned technique in which the abnormal trace of the sheet is detected by the transmission optical sensor, there is a possibility that such a large change of the trace of the sheet is recognized. However, even if the large change of the trace of the sheet immediately before the jamming is generated is recognized and control to avoid the jamming can be initiated, the sheet is already beginning to be congested at the downstream side of the fixing roller, and thus, actually, generation of the jamming is sometimes not capable of being avoided.

SUMMARY

In accordance with an embodiment of the present disclosure, a fixing device that is provided on the way of a conveying path of a recording medium, and configured to fix an image formed on the recording medium to the recording medium includes a fixing member configured to rotate around a first axis, a pressing member configured to rotate around a second axis parallel to the first axis, a heat source configured to heat the fixing member, a nip forming mechanism configured to press the fixing member and the pressing member one another to form a nip part between the fixing member and the pressing member, a separating plate placed at a downstream side of the nip part in the conveying path of the recording medium, having a receiving surface, and make a front end side of the recording medium ejected from the nip part come into contact with the receiving surface to separate the recording medium from the fixing member and orient the recording medium to the conveying path, a detector configured to detect a bending or leaping up of the front end side of the recording medium ejected from the nip part, and an ejecting direction controller configured to change an ejecting direction of the recording medium ejected from the nip part based on a detection result of the detector, in which, in the receiving surface, in a region closer to the nip part than a region with which the front end side of the recording medium ejected from the nip part comes contact in a normal operation time, a catch part having a recessed, projected or stepwise shape and configured to catch the front end part of the recording medium ejected from the nip part is formed.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION (First Embodiment)

Figure 1:
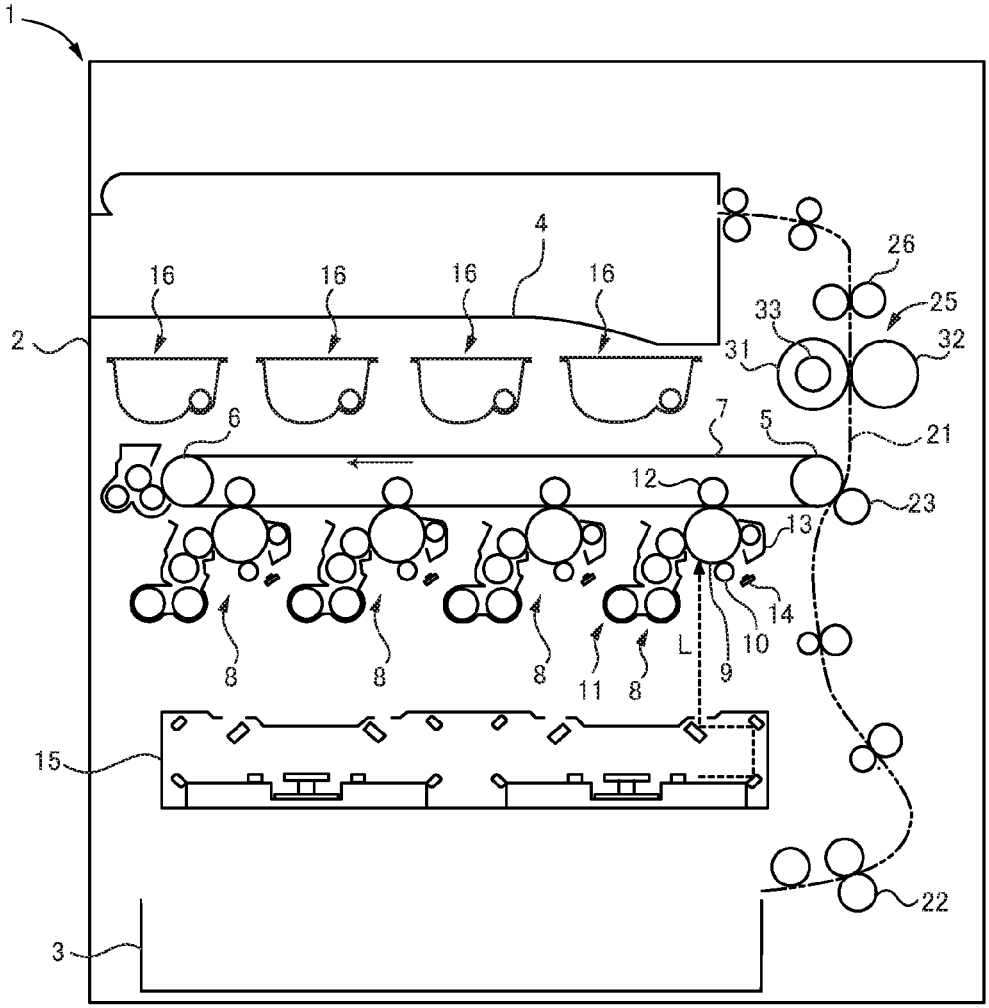
FIG. 1 is an explanatory drawing showing an image forming apparatus according to a first embodiment of the present disclosure.

FIG. 1 shows an image forming apparatus according to a first embodiment of the present disclosure. As shown in FIG. 1, an image forming apparatus 1 according to the first embodiment of the present disclosure is an electrographic image forming apparatus, for example, a color printer.

In a lower part of a housing 2 of the image forming apparatus 1, a sheet feeding cartridge 3 configured to accommodate sheets that serve as recording mediums is installed, and an upper part of the housing 2, a sheet ejecting tray 4 in which the printed sheets are ejected is provided. In addition, in the housing 2, an intermediate transferring belt 7 is looped over a drive roller 5 and a co-rotation roller 6, four image forming parts 8 corresponding to respective four colors such as magenta, cyan, yellow and black are provided so as to be along the intermediate transferring belt 7. In addition, each of the image forming parts 8 includes a photosensitive drum 9, a charger 10, a development device 11, a primary transfer roller 12, a cleaning device 13, and a static eliminator 14. In addition, in the housing 2, an exposure device 15 constructed by a laser scanning unit is provided. Further, in the housing 2, four toner containers 16 respectively corresponding to the above-mentioned four colors are provided.

In addition, in the housing 2, a conveying path 21 configured to convey the sheets from a side at which the sheet feeding cartridge 3 is placed to a side at which the sheet ejecting tray 4 is placed. In addition, in the conveying path 21, a sheet feeding roller 22 is provided in the vicinity of the sheet feeding cartridge 3, and a secondary transfer roller 23 that faces the drive roller 5 is provided at a downstream side of the sheet feeding roller 22. Further, a fixing device 25 is provided at a downstream side of the secondary transfer roller 23, and an ejecting roller 26 is provided at a downstream side of the fixing device 25.

In addition, in the housing 2, a controller 27 (see FIG. 5) that controls respective devices provided in the image forming apparatus 1 including the fixing device 25 is provided. The controller 27 has a processor controller and a storage device and the like.

Printing operation of the image forming apparatus 1 having such a configuration is as follows. When data of an image to be printed on the sheet is inputted in the image forming apparatus 1, upon initiation of a printing treatment, the drive roller 5 and the co-rotation roller 6 rotate, and the intermediate transferring belt 7 rotates. In addition, in the image forming part 8 placed at the most upstream side of the intermediate transferring belt 7, image forming treatment of one color of the above-mentioned four colors is carried out. Specifically, in the image forming parts 8, the surface of the photosensitive drum 9 is charged by the charger 10, laser light L corresponding to the image data is radiated from the exposure device 15 to the photosensitive drum 9, an electrostatic latent image is formed on the surface of the photosensitive drum 9, further, a toner image corresponding to the electrostatic latent image is formed on the surface of the photosensitive drum 9 by a development device 11. Then, the toner image formed on the surface of the photosensitive drum 9 is transferred to the surface of the intermediate transferring belt 7 by the primary transfer roller 12. After the toner image is transferred, the toner remaining on the surface of the photosensitive drum 9 is removed and collected by the cleaning device 13, and an electric charge on the surface of the photosensitive drum 9 is removed by the static eliminator 14. Further, image forming treatments of the remaining three colors similar to the above-mentioned image forming treatment are sequentially carried out in other three image forming parts 8. In addition, in the respective image forming parts 8, the toner images formed on the surface of the photosensitive drum 9 are transferred on the surface of the intermediate transferring belt 7 such that the respective toner images overlap with each other. As a result, a toner image of color image is formed on the surface of the intermediate transferring belt 7.

On the other hand, the sheets accommodated in the sheet feeding cartridge 3 is conveyed by the sheet feeding roller 22 and the like and pass between the intermediate transferring belt 7 around the drive roller 5 and the secondary transfer roller 23. In this time, the toner image formed on the surface of the intermediate transferring belt 7 is transferred on the surface of the sheet. Subsequently, the sheet having a transferred toner image passes between the fixing roller 31 and the pressing roller 32 of the fixing device 25. In this time, the toner image is melted due to heat of the fixing roller 31 heated by a halogen heater 33 to be fixed to the sheet. The sheet having a fixed toner image is conveyed by the ejecting roller 26 and the like, and is ejected to the sheet ejecting tray 4.

Figure 2:
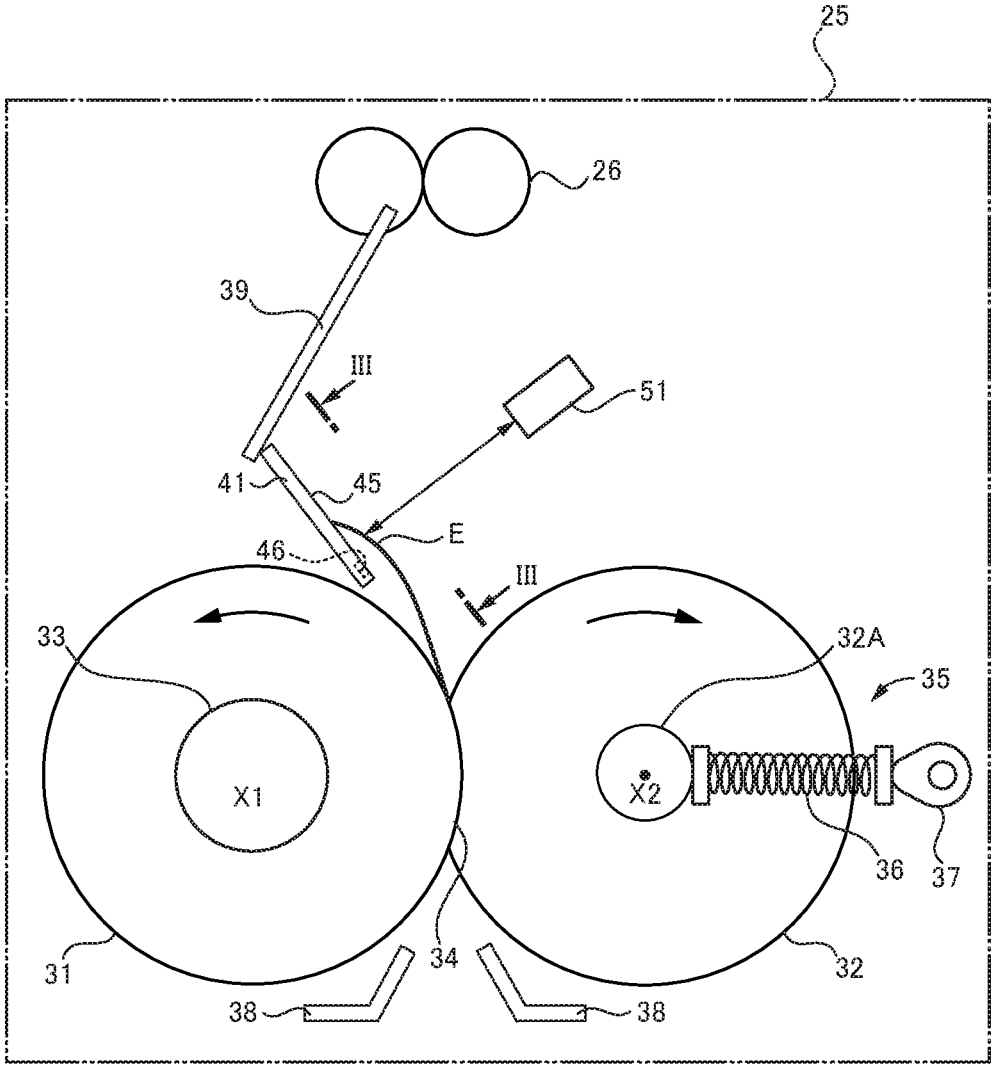
FIG. 2 is an explanatory drawing showing a fixing device according to the first embodiment of the present disclosure.
Figure 3:
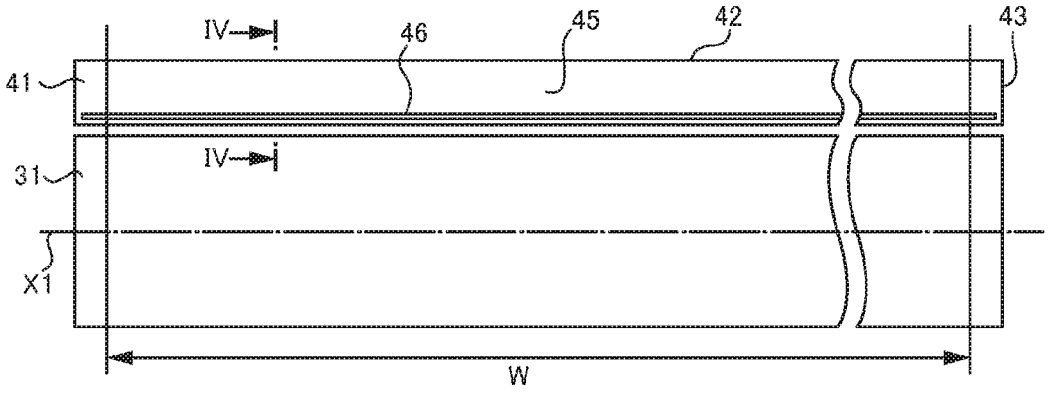
FIG. 3 is an explanatory drawing showing a separating plate seen from a direction along a arrow in FIG. 2 together with the fixing roller.
Figure 4:
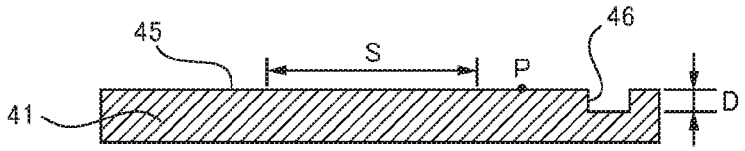
FIG. 4 is a sectional view showing the separating plate seen from a direction seen from a IV-IV arrow in FIG. 3.
Figure 5:
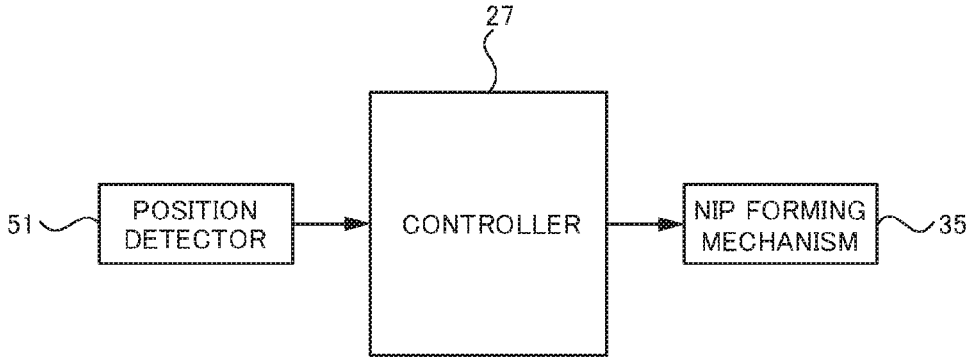
FIG. 5 is a schematic block diagram showing a configuration concerning control in the fixing device according to the first embodiment of the present disclosure.

FIG. 2 shows the fixing device 25 according to an embodiment of the present disclosure. FIG. 3 shows a separating plate 41 seen from a direction along an arrow in FIG. 2 together with the fixing roller 31, and FIG. 4 shows a sectional plane of the separating plate 41 seen from a direction along an arrow IV-IV in FIG. 3. In addition, FIG. 5 shows a configuration concerning control in the fixing device 25.

The fixing device 25, as shown in FIG. 1, is provided on the way of the conveying path 21 of the sheet, and is a device configured to fix the toner image formed on the sheet to the sheet. As shown in FIG. 2, the fixing device 25 includes the fixing roller 31 that serves as a fixing member, the pressing roller 32 that serves as a pressing member, the halogen heater 33 that serves as a heat source and a nip forming mechanism 35.

The fixing roller 31 is formed in a cylindrical shape elongated in an axis direction thereof, and is rotatably supported around an axis X1 by a frame (not shown) that forms a contour of the fixing device 25. In addition, the length of the fixing roller 31 in the axis direction is set to be longer than a width of the sheet having a maximum size usable in the image forming apparatus 1 (length of the sheet in a direction orthogonally crossing the conveyance direction of the sheet). In addition, the fixing roller 31 is formed by, for example, laminating PFA (tetrafluoroethylene perfluoromethylalkylvinyl ether copolymer) on the circumference face of a cored bar made of aluminum.

The pressing roller 32 is formed in a cylindrical shape elongated in an axis direction thereof, and is rotatably supported around an axis X2 parallel to the axis X1 by the frame of the fixing device 25. In addition, the length of the pressing roller 32 in the axis direction is identical to the length of the fixing roller 31 in the axis direction. In addition, the pressing roller 32 is formed by laminating a silicone rubber layer on the cored bar made of aluminum and covering with a PFA tube. In addition, the pressing roller 32 is rotated by a drive mechanism (not shown) including a motor and a power transmission mechanism or the like.

The halogen heater 33 is provided in an inner part of the cored bar of the fixing roller 31. The halogen heater 33 heats the entire region through which the sheet passes in the fixing roller 31.

The nip forming mechanism 35 is a mechanism configured to press the fixing roller 31 and the pressing roller 32 one another to form a nip part 34 between the fixing roller 31 and the pressing roller 32. In addition, the nip forming mechanism 35 changes an amount of the force for pressing the fixing roller 31 and the pressing roller 32 one another, thereby changing a pressure applied to the sheet that passes through the nip part 34 (i.e. nip pressure).

Specific configuration of the nip forming mechanism 35 is as follows. An axis part 32A of the pressing roller 32 is movably supported by the frame of the fixing device 25 in a predetermined distance in a direction close to/apart from the fixing roller 31. The nip forming mechanism 35 includes a pair of biasing parts 36 (Only one of the pair is shown) and a cam 37. The pair of the biasing parts 36 respectively press both end parts of the axis part 32A of the pressing roller 32 toward a direction that the axis part 32A of the pressing roller 32 comes close to the fixing roller 31. The cam 37 change pressing force of each of the biasing parts 36 that press the pressing roller 32 by changing the position thereof in the rotation direction.

Figure 6A:
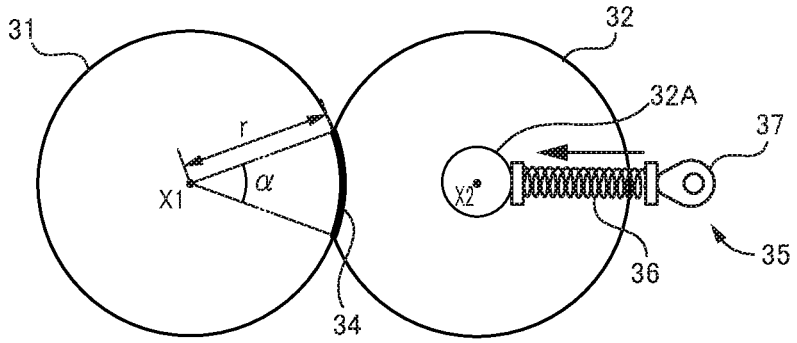
FIG. 6A and FIG. 6B are explanatory drawings showing an operation of a nip forming mechanism in the fixing device according to the first embodiment of the present disclosure.
Figure 6B:
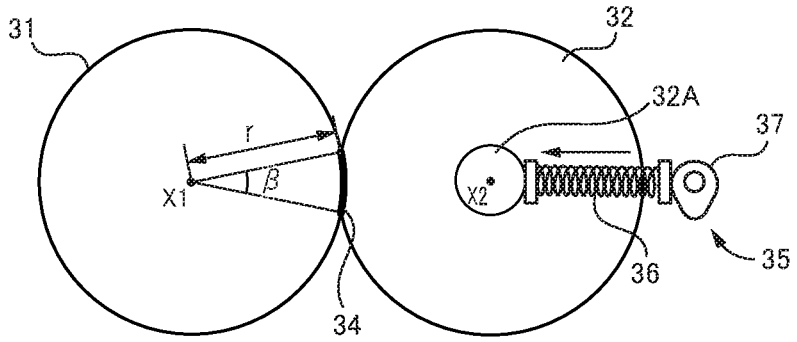

Here, FIG. 6A and FIG. 6B show an operation that the nip forming mechanism 35 changes the amount of force for pressing the fixing roller 31 and the pressing roller 32. As shown in FIG. 6A, when the cam 37 is rotated to set the position thereof to a first predetermined position, force that the cam 37 presses each of the biasing parts 36 increases, the force that each of the biasing parts 36 presses the pressing roller 32 increases, thereby causing an increase in the force for pressing the fixing roller 31 and the pressing roller 32 one another. As a result, in the present embodiment, the degree that a part of the circumference face of the pressing roller 32 is pressed by the fixing roller 31 and is subject to elastic deformation in a recessed shape becomes large. When the degree that the circumference face of the pressing roller 32 is subject to elastic deformation in a recessed shape increases, the length of a part in which the circumference face of the fixing roller 31 and the circumference face of the pressing roller 32 directly press one another(a part in which the circumference face of the fixing roller 31 and the circumference face of the pressing roller 32 are into contact with each other when the sheet does not pass), in other words, the length of the nip part 34 is lengthened. For example, when it is assumed that the fixing roller 31 never deforms and only the pressing roller 32 is pressed onto the fixing roller 31 to deform, the radius of the fixing roller 31 is denoted as "r", an angle of a fan-shaped part that forms the nip part 34 in the fixing roller 31 is denoted as "$\alpha$", the length of the nip part 34 is denoted as "$2\pi r \times \alpha/360$".

On the other hand, as shown in FIG. 6B, when the cam 37 is rotated to set the position thereof to a second predetermined position, force that the cam 37 presses each of the biasing parts 36 decreases, force that each of the biasing parts 36 presses the pressing roller 32 decreases, thereby causing a decrease in the force for pressing the fixing roller 31 and the pressing roller 32 one another. As a result, in the present embodiment, the degree that a part of the circumference face of the pressing roller 32 is pressed by the fixing roller 31 and is subject to elastic deformation in a recessed shape decreases. When the degree that the circumference face of the pressing roller 32 is subject to elastic deformation in a recessed shape decreases, the length of the nip part 34 is shortened. For example, when the position of the cam 37 os set tp the second predetermined position, an angle of the fan-shaped part that forms the nip part 34 in the fixing roller 31 is "β" that is smaller than "α", and the length of the nip part 34 is "2πr×β/360".

In addition, as shown in FIG. 2, the fixing device 25 is provided with an upstream side guide plate 38 placed at an upstream side of the nip part 34 in the conveying path 21 of the sheet (see FIG. 1) and configured to guide the sheet that moves into the fixing device 25 to the nip part 34, a downstream side guide plate 39 placed at a downstream side of the nip part 34 in the conveying path 21 of the sheet and configured to guide the sheet that is ejected from the nip part 34 to the downstream side of the conveying path 21, and the ejecting roller 26 placed at a downstream side of the nip part 34 in the conveying path 21 of the sheet and configured to convey the sheet that is ejected from the nip part 34 to a downstream side of the conveying path 21.

In addition, as shown in FIG. 2, the fixing device 25 includes a separating plate 41. The separating plate 41 is placed at a downstream side of the nip part 34 in the conveying path 21 of the sheet. The separating plate 41, as shown in FIG. 3, is formed in an elongate rectangular flat plate shape having long sides 42 extending in parallel with the axis X1 of the fixing roller 31 and short sides 43 extending along the conveyance direction of the sheet. In addition, the length of each long side 42 of the separating plate 41 is set to be longer than a width W of a sheet having a maximum size usable in the image forming apparatus 1. In addition, the length of each short side 43 of the separating plate 41 is, for example, about 300 mm to 500 mm. In addition, the thickness of the separating plate 41 is, for example, about 100 μm to 500 μm. In addition, the separating plate 41 is formed by, for example, coating the surface of the stainless plate with a fluorine resin. In addition, in the separating plate 41, an edge part of the long side 42 facing the nip part 34 is extremely close to the circumference face of the fixing roller 31 but is not contact with the circumference face of the fixing roller 31, and is apart from the circumference face of the fixing roller 31 by a predetermined distance.

In addition, the separating plate 41 has a receiving surface 45. Specifically, as shown in FIG. 2, of surfaces of the separating plate 41, a flat surface facing the conveying path 21 of the sheet is the receiving surface 45. The separating plate 41 has a function of separating the sheet from the fixing roller 31 by making the front end side of the sheet that is ejected from the nip part 34 come into contact with the receiving surface 45 and make the sheet be oriented to the conveying path 21 at the downstream side of the nip part 34.

In addition, a catch part 46 is formed in the receiving surface 45 of the separating plate 41. As understood with reference to FIG. 4 showing by enlarging a cross section of the separating plate 41, the catch part 46 is a depression or groove formed in a recessed shape. The depth D of the catch part 46 is favorably not less than a thickness of the sheet, and in the present embodiment, is set to, for example, about 50 μm. In addition, as shown in FIG. 3, the catch part 46 extends in parallel with the axis X1 of the fixing roller 31. In addition, the length of the catch part 46 is set to be longer than the width W of the sheet having a maximum size usable in the image forming apparatus 1, and is set to be, for example, identical to the length of the long sides 42 of the separating plate 41 or slightly shorter than the length of the long sides 42 of the separating plate 41.

In addition, in the receiving surface 45, the catch part 46 is formed in a region closer to the nip part 34 than a region with which the front end side of the sheet ejected from the nip part 34 in a normal operation time of the fixing device 25 comes into contact. In the present embodiment, the catch part 46, as shown in FIG. 2, is formed in an edge part at a side closer to the nip part 34 in the receiving surface 45.

The normal operation time of the fixing device 25 referred herein is a time during which the hardness of the pressing roller 32 does not decrease, the length of the nip part 34 is kept to a preset length, and the ejecting direction of the sheet that is ejected from the nip part 34 is a preset direction. Specifically, for example, when a continuous printing is carried out for a long period of time, the hardness of the pressing roller 32 decreases, thereby increasing in a degree of the elastic deformation in a recessed shape of the pressing roller 32. As a result, the nip part 34 is elongated, and the sheet ejected from the nip part 34 sometimes excessively comes close to the fixing roller 31. The normal operation time of the fixing device 25 is a time during which such a situation is not caused. For example, when frequency of printing operation is low in the image forming apparatus 1, for example, when printing operation of about one to three sheets having an A4 size is intermittently carried out, the hardness of the pressing roller 32 does not decrease, the length of the nip part 34 is kept to a preset length, and the ejecting direction of the sheet ejected from the nip part 34 keeps a preset direction. Therefore, the time when the frequency of the printing operation in the image forming apparatus 1 is low can be considered as the normal operation time of the fixing device 25.

In addition, in the receiving surface 45 of the separating plate 41, a region with which the front end side of the sheet ejected from the nip part 34 comes into contact in the normal operation time of the fixing device 25 is a region to some extent apart from the edge part of a side close to the nip part 34 in a short side direction of the separating plate 41, for example, an intermediate region in the short side direction of the receiving surface 45, and more specifically, is a region shown by an arrow S in FIG. 4. It is to be noted that, on the receiving surface 45 of the separating plate 41, a region with which the front end side of the sheet ejected from the nip part 34 in the normal operation time of the fixing device 25 can be decided by appropriately setting the force for pressing the fixing roller 31 and the pressing roller 32 one another in the normal operation time. For example, the force for pressing the fixing roller 31 and the pressing roller 32 is adjusted in the normal operation time, and the front end side of the sheet ejected from the nip part 34 is allowed to come into contact with the intermediate region of the receiving surface 45 in the short side direction.

Further, as shown in FIG. 2, the fixing device 25 includes a position detector 51. The position detector 51 detects the condition of the sheet that is ejected from the nip part 34. Specifically, the position detector 51 of the present embodiment detects a leaping up at a front end side of the sheet ejected from the nip part 34. More specifically, the position detector 51 detects the leaping up at a front end side of the sheet ejected from the nip part 34 by radiating light toward a direction crossing the conveying path 21 of the sheet at a downstream side of the nip part 34 and detecting the position which the light reaches the front end side of the sheet ejected from the nip part 34.

In the present embodiment, the position detector 51 includes a radiation device configured to radiate laser light M, a light receiving device configured to receive reflection light of the laser light M. The position detector 51 radiates the laser light M from the radiation device, focuses the laser light M on the sheet ejected from the nip part 34, receives the laser light M reflected onto the sheet by the light receiving device, and detects a distance between the position detector 51 and the sheet on which the laser light M is focused based on the strength of the laser light M received.

The position detector 51 is placed in a position facing the conveying path 21 of the sheet at the downstream side of the nip part 34. In addition, the position detector 51 is placed in a position apart from the receiving surface 45 by a predetermined distance. The predetermined distance is set to be a distance such that the sheet does not come contact with the position detector 51 even if the sheet ejected from the nip part 34 leaps up as described later. The position detector 51 is attached to the frame of the fixing device 25 using a bracket (not shown), for example.

In addition, it is preferred that the radiation position of the light radiated from the position detector 51 is set to be a position in which the catch part 46 is formed in the receiving surface 45, a position slightly displaced in a direction more apart from the nip part 34 from a position in which the catch part 46 is formed, or a position slightly displaced in a direction closer to the nip part 34 than a position in which the catch part 46 is formed or the like. In the present embodiment, the radiation position of the light, as shown in FIG. 4 or FIG. 7, is set to be a position P slightly displaced in a direction more apart from the nip part 34 than a position in which the catch part 46 is formed (a position between the region S and the catch part 46 in FIG. 4).

Further, as shown in FIG. 5, to the controller 27 provided in the image forming apparatus 1, the position detector 51 and the nip forming mechanism 35 are connected. The controller 27 controls the nip forming mechanism 35 based on a detection result of the position detector 51, and changes the direction of the sheet ejected from the nip part 34. The mechanism in which the direction of the sheet that is ejected from the nip part 34 is as follows. When force by which the fixing roller 31 and the pressing roller 32 are pressed one another decreases, the nip part 34 is shortened, the ejecting direction of the sheet that is ejected from the nip part 34 is changed in a direction apart from the circumference face of the fixing roller 31.

The controller 27 controls the cam 37 of the of the nip forming mechanism 35, changes a position of the cam 37 in a rotation direction, and decreases the force for pressing the fixing roller 31 and the pressing roller 32 one another, thereby changing the direction of the front end part of the sheet that is ejected from the nip part 34 to a direction apart from the circumference face of the fixing roller 31.

Figure 7:
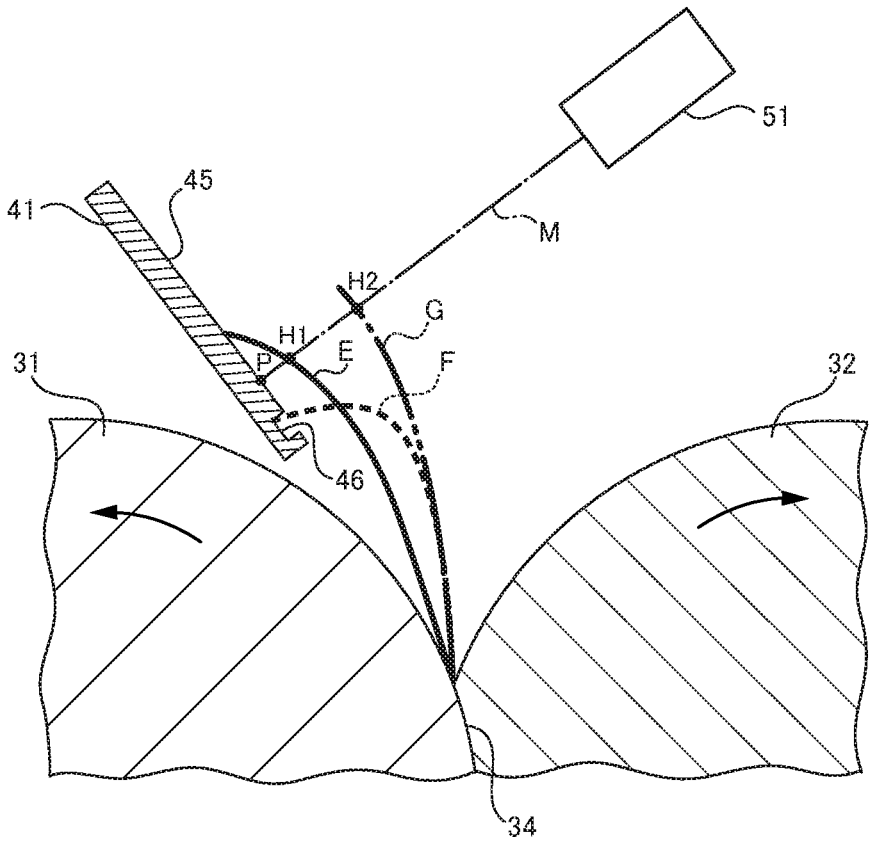
FIG. 7 is an explanatory drawing showing a configuration and an operation for detecting a bending or leaping up of the sheet in the fixing device according to the first embodiment of the present disclosure.

FIG. 7 shows an operation of the fixing device 25. In FIG. 2 or FIG. 7, the pressing roller 32 rotates by the drive mechanism, in accordance with the rotation of the pressing roller 32, the fixing roller 31 that is pressed against the pressing roller 32 rotates. In FIG. 2 or FIG. 7, the rotation direction of the pressing roller 32 is clockwise, and the rotation direction of the fixing roller 31 is counterclockwise. In addition, the fixing roller 31 is heated by a halogen heater 33.

The sheet having a transferred toner image on a surface thereof after the secondary transfer enters the nip part 34 between the fixing roller 31 and the pressing roller 32 from a lower side of the nip part 34 in FIG. 2 or FIG. 7. In the nip part 34, the surface of the sheet on which the toner image is formed comes into contact with the circumference face of the fixing roller 31. The toner image on the sheet is heated by the fixing roller 31, is pressurized by the pressing roller 32, and is fixed on the sheet.

Then, the sheet is ejected upward from the nip part 34 in FIG. 2 or FIG. 7. In this time, toner is mostly present in parts other than margins on the surface of the sheet, so that the toner tends to be adhered to the circumference face of the fixing roller 31 due to viscosity. On the other hand, margins are present at the front end side of the sheet and toner is absent, so that the front end side of the sheet is separated from the circumference face of the fixing roller 31. However, the pressing roller 32 is pressed against the fixing roller 31 to deform in a recessed shape. As a result, the nip part 34 is curved. Therefore, the front end part of the sheet that is ejected from the nip part 34 tends to come close to the circumference face of the fixing roller 31. And, the front end side of the sheet ejected from the nip part 34 is oriented to the receiving surface 45 of the separating plate 41.

Then, in the normal operation time of the fixing device 25, the front end side of the sheet ejected from the nip part 34, like a sheet E shown by solid lines in FIG. 7, flies over the catch part 46 formed in the receiving surface 45, passes above the catch part 46, comes into contact with (land) the intermediate region of the receiving surface 45 in the short side direction (region S in FIG. 4). Coming of the front end side of the sheet into contact with the intermediate region of the receiving surface 45 changes the ejecting direction of the sheet such that the ejecting direction of the sheet is along the conveying path 21. Thereafter, the sheet is guided by the downstream side guide plate 39 and the ejecting roller 26 and conveyed from the fixing device 25 to a downstream side of the conveying path 21. In such a situation, the sheet ejected from the nip part 34 smoothly flows to the downstream side of the conveying path 21, so that there is a low risk that the jamming is generated inside the fixing device 25.

On the other hand, when the fixing device 25 is not in a normal operation, in the receiving surface 45 of the separating plate 41, the position with which the front end side of the sheet ejected from the nip part 34 comes into contact is displaced in a direction close to the nip part 34. Specifically, for example, when a continuous printing is carried out for a long period of time, the hardness of the pressing roller 32 decreases. Thereby, the degree that the pressing roller 32 is subject to elastic deformation in a recessed shape increases. As a result, the nip part 34 becomes longer. As the nip part 34 becomes longer, the ejecting direction of the sheet that is ejected from the nip part 34 comes close to the circumference face of the fixing roller 31. As a result, in the receiving surface 45 of the separating plate 41, the position with which the front end side of the sheet comes into contact is gradually displaced to a direction close to the nip part 34.

In such a situation, in the future, there is a risk that the hardness of the pressing roller 32 further decreases, the nip part 34 becomes further longer, the ejecting direction of the sheet that is ejected from the nip part 34 further comes close to the circumference face of the fixing roller 31, and finally the front end part of the sheet ejected from the nip part 34 deviates from the receiving surface 45 of the separating plate 41 and comes into contact with the end surface at the nip side of the separating plate 41 to cause the jamming. However, the current stage is an initial stage at which a risk of generation of the jamming is caused, and is not a stage immediately before the jamming is generated.

When the position that the front end side of the sheet comes into contact with the receiving surface 45 of the separating plate 41 becomes displaced in a direction close to the nip part 34, the front end side of the sheet becomes unable to fly over the catch part 46 formed in the receiving surface 45 with time. As a result, like the sheet F shown by a dot line in FIG. 7, the front end part of the sheet enters the catch part 46. The sheet is pressed toward the ejecting direction by the fixing roller 31 and the pressing roller 32 in the state where the front end part of the sheet enters the catch part 46, so that the front end side of the sheet is largely bent and is protruded toward a direction apart from the receiving surface 45. After the front end part of the sheet enters the catch part 46, the front end part of the sheet gets out of the catch part 46, due to elastic force of the bent sheet, as a sheet G shown by a two-dot chain line in FIG. 7. At this time, the front end side of the sheet largely leaps up (floats up) toward a direction apart from the receiving surface 45.

Here, the position detector 51 detects the position of the front end side of the sheet ejected from the nip part 34. Specifically, the position detector 51 radiates the laser light M toward a position slightly displaced more apart from the nip part 34 than a position where the catch part 46 is formed in the receiving surface 45 of the separating plate 41 (concretely, a position P in FIG. 4). In the normal operation time of the fixing device 25, like a sheet E shown by a solid line in FIG. 7, when the sheet ejected from the nip part 34 smoothly flows toward the downstream side of the conveying path 21, the laser light M is focused on the front end side of the sheet in a position H1. To the contrary, in a case where the fixing device 25 is not in the normal operation time, like a sheet G shown by a two-dot chain line in FIG. 7, when the front end side of the sheet ejected from the nip part 34 leaps up by entering and getting out of the catch part 46, the laser light M is focused on the front end side of the sheet in a position H2. As understood from FIG. 7, the position H2 is more apart from the receiving surface 45 than the position H1, and close to the position detector 51. The position detector 51 detects a distance between the position detector 51 and the position where the laser light M is focused on the front end side of the sheet, and outputs a detection signal that shows the detection result to the controller 27.

The controller 27 receives the detection signal outputted from the position detector 51 and recognizes the presence/absence of the leaping up of the front end side of the sheet that is ejected from the nip part 34 based on the detection signal, and determines whether or not the degree that the ejecting direction of the sheet that is ejected from the nip part 34 comes close to the circumference face of the fixing roller 31 increases, based on the presence/absence of the leaping up. In addition, when the controller 27 determines that the degree that the ejecting direction of the sheet ejected from the nip part 34 comes close to the circumference face of the fixing roller 31 increases, the controller 27 controls the nip forming mechanism 35, as shown in FIG. 6B, decreases the force for pressing the fixing roller 31 and the pressing roller 32 one another, thereby changing the direction of the front end part of the sheet that is ejected from the nip part 34 to a direction apart from the circumference face of the fixing roller 31. As a result, like the sheet E shown by the solid line in FIG. 7, the front end side of the sheet that is ejected from the nip part 34 flies over the catch part 46 and comes into contact with the intermediate region of the receiving surface 45 in the short side direction. Therefore, the sheet ejected from the nip part 34 smoothly flows at the downstream side of the conveying path 21. As a result, generation of the jamming is prevented.

On the other hand, when the controller 27 determines that the degree that the ejecting direction of the sheet ejected from the nip part 34 comes close to the circumference face of the fixing roller 31 does not increase based on the detection signal outputted from the position detector 51, the controller 27 maintains the present condition of the nip forming mechanism 35, and maintains the direction of the front end part of the sheet that is ejected from the nip part 34 as it is.

As described above, in the fixing device 25 according to the embodiment of the present disclosure, the catch part 46 is formed in the receiving surface 45 of the separating plate 41, and when the degree that the ejecting direction of the sheet ejected from the nip part 34 comes close to the circumference face of the fixing roller 31 increases, the catch part 46 catches the front end part of the sheet, and then releases the front end part of the sheet therefrom, and makes the front end side of the sheet leap up, thereby largely changing the condition of the sheet that ejected from the nip part 34. Then, the position detector 51 detects the large change of the condition of the sheet emphasized in such a manner. Accordingly, an increase of the degree that the ejecting direction of the sheet ejected from the nip part 34 comes close to the circumference face of the fixing roller 31 can be clearly recognized, which enables a sure avoiding generation of the jamming.

In addition, according to the fixing device 25, a risk of generation of the jamming can be recognized in an early stage. In other words, the fixing device 25 can recognize the risk of the generation of the jamming not immediately before the generation of the jamming, but an earlier stage. Therefore, the generation of the jamming can be surely inhibited.

In addition, in the fixing device 25, the catch part 46 is formed in an edge part at a side close to the nip part 34 in the receiving surface 45 of the separating plate 41. Therefore, the sheet ejected from the nip part 34 in the normal operation time surely flies over the catch part 46. In other words, an error that the catch part 46 catches the sheet despite in the normal operation time can be prevented. Namely, only when the degree that the ejecting direction of the sheet ejected from the nip part 34 comes close to the circumference face of the fixing roller 31 increases, the sheet can be caught by the catch part 46. According to this, the increase of the degree that the ejecting direction of the sheet ejected from the nip part 34 comes close to the circumference face of the fixing roller 31 can be recognized with high accuracy, which enables prevention of erroneous recognition.

In addition, in the receiving surface 45 of the separating plate 41, the length of the catch part 46 is set to be longer than the width W of the sheet having a maximum size usable in the image forming apparatus 1, so that the front end part of the sheet ejected from the nip part 34 can be surely caught. That makes it possible for the amount of the bending or leaping up of the sheet in catching or releasing to be large and for the position detector 51 to more clearly detect the bending or leaping up of the sheet.

In addition, in the fixing device 25, the position detector 51 radiates light along a direction crossing the conveying path 21 of the sheet at the downstream side of the nip part 34 and detects a position where the light reaches the front end side of the sheet ejected from the nip part 34, thereby detecting the leaping up of the front end side of the sheet ejected from the nip part 34. That makes it possible for the position detector 51 to easily detect the bending or leaping up of the sheet when the catch part 46 catches or releases the sheet. In addition, in the fixing device 25, the position of the front end side of the sheet ejected from the nip part 34 is detected by using the laser light M reflected at the front end side of the sheet, thereby enabling detection with high accuracy of the leaping up of the sheet getting out of the catch part 46 with a compact configuration.

In addition, in the fixing device 25, the nip forming mechanism 35 is controlled and the force for pressing the fixing roller 31 and the pressing roller 32 one another is decreased, thereby enabling sure separating the ejecting direction of the sheet ejected from the nip part 34 from the fixing roller 31.

(Second Embodiment)

Figure 8:
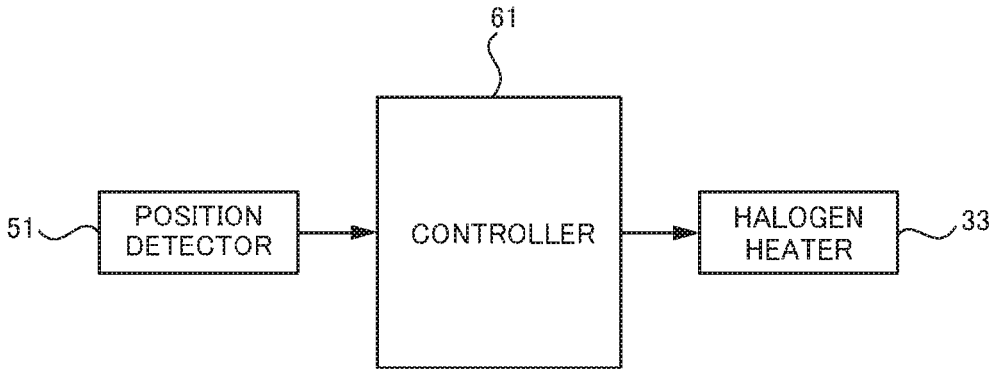
FIG. 8 is a schematic block diagram showing a configuration concerning control in the fixing device according to a second embodiment of the present disclosure.

FIG. 8 shows a configuration concerning control in a fixing device according to a second embodiment of the present disclosure. As shown in FIG. 8, to a controller 61 of the fixing device or an image forming apparatus including the fixing device according to the second embodiment of the present disclosure, the position detector 51 and a halogen heater 33 are connected. The controller 61 controls the halogen heater 33 and changes the direction of the sheet that is ejected from the nip part 34 based on a detection result of the position detector 51.

The mechanism of changing the direction of the sheet that is ejected from the nip part 34 is as follows. The front end part of the sheet ejected from the nip part 34 is curved in a direction coming close to the fixing roller 31. The degree of the curvature is large as the fixing temperature increases and is small as the fixing temperature decreases. Therefore, the controller 61 controls the halogen heater 33 to decrease the fixing temperature, thereby enabling a decrease in the degree of the curvature of the sheet. That enables a change of the direction of the front end part of the sheet ejected from the nip part 34 to a direction apart from the circumference face of the fixing roller 31.

The fixing device according to the second embodiment has a configuration similar to the fixing device 25 according to the first embodiment except that a means for decreasing the fixing temperature is employed instead of a means for decreasing force for pressing the fixing roller 31 and the pressing roller 32 as a means for changing the ejecting direction of the sheet that is ejected from the nip part 34.

Also according to the fixing device according to the second embodiment, actions and effects similar to the fixing device 25 according to the first embodiment can be obtained. Further, according to the fixing device of the second embodiment, the change of the ejecting direction of the sheet that is ejected from the nip part 34 can be easily realized without adding complex mechanisms.

Figure 9:
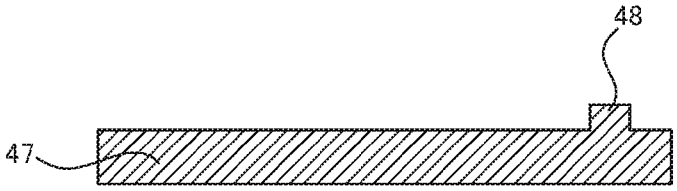
FIG. 9 is a sectional view showing a variation example of the separating plate in the fixing device according to the first or second embodiment of the present disclosure.
Figure 10:
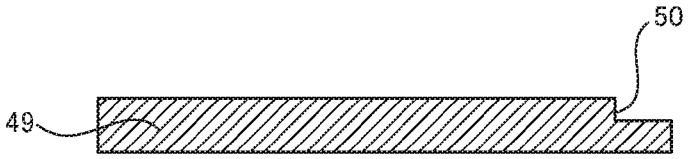
FIG. 10 is a sectional view showing another variation example of the separating plate in the fixing device according to the first or second embodiment of the present disclosure.

It is to be noted that, in each of the embodiment described above, as shown in FIG. 4, the catch part 46 of the separating plate 41 is formed in a recessed shape. Meanwhile, for example, as shown in FIG. 9, a catch part 48 of a separating plate 47 may be formed in a projected shape, or as shown in FIG. 10, a catch part 50 of a separating plate 49 may be formed in a stepwise shape (or formed as a difference in thickness in the edge portion).

In addition, in each of the embodiment described above, as shown in FIG. 3, a case in which the catch part 46 is continuously extended in the axis direction in the receiving surface 45 of the separating plate 41 is exemplified. Meanwhile, for example, a plurality of short projected catch parts may be arranged at predetermined intervals in the axis direction on the receiving surface 45.

Figure 11:
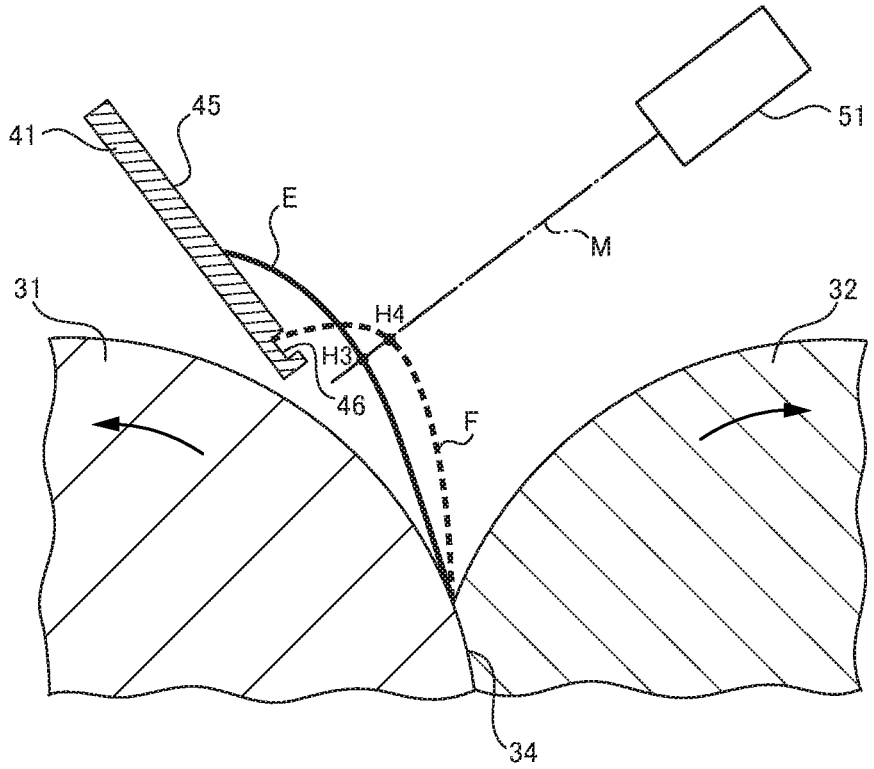
FIG. 11 is an explanatory drawing showing another configuration and an operation for detecting a bending or leaping up of the sheet in the fixing device according to the first or second embodiment of the present disclosure.

In addition, in the first embodiment described above, as shown in FIG. 7, a case in which the radiation position of the laser light M radiated from the position detector 51 is set to be the position P slightly displaced in a direction more apart from the nip part 34 than a position in which the catch part 46 is formed in the receiving surface 45 of the separating plate 41 is exemplified. Meanwhile, not limited to this, for example, as shown in FIG. 11, the irradiation position of the laser light M may be set to be a position slightly displaced in a direction coming closer to the nip part 34 than a position where the catch part 46 is formed in the receiving surface 45. In this case, in the normal operation time of the fixing device 25, the position where the laser light M is focused on the sheet E that flies over the catch part 46 and smoothly flows is a position H3. In addition, when the fixing device 25 is not in the normal operation time, the position where the laser light M is focused on the sheet F that is caught by the catch part 46 and is largely bent to be protruded from the receiving surface 45 is a position H4. The position detector 51 detects a distance between the position detector 51 and the position where the laser light M is focused on the sheet, thereby detecting a large bending of the front end side of the sheet ejected from the nip part 34. Then, the controller 27 recognizes presence/absence of the bending of the front end side of the sheet ejected from the nip part 34 based on the detection result, and determines if the degree that the ejecting direction of the sheet ejected from the nip part 34 comes close to the circumference face of the fixing roller 31 increases or not.

In addition, a radiation part and a light receiving part of the position detector 51 may be respectively placed at both end sides in the axis direction of the place where the sheet is ejected from the nip part 34, and the laser light M may be radiated along the axis direction, whereby the leaping up or bending of the sheet that is ejected from the nip part 34 may be detected. For example, when the sheet leaps up or is bent, the laser light M radiated from the radiation part to the light receiving part is configured to be blocked by the sheet.

In addition, the position detector 51 may continuously detect the leaping up or bending of the sheet ejected from the nip part 34, and the force for pressing the fixing roller 31 and the pressing roller 32 or the fixing temperature may be increased/decreased in a multi-stage or continuous manner based on the frequency of the leaping up or bending or the like.

In addition, in each of the embodiment described above, a case where the pressing roller 32 is pressed by the fixing roller 31 to deform is exemplified. Meanwhile, the fixing device of the present disclosure can be applied to a case where the fixing roller 31 is pressed by the pressing roller 32 to deform, or a case where both of the fixing roller 31 and the pressing roller 32 press each other to deform.

In addition, in the fixing device of the present disclosure, the heat source is not limited to the halogen heater, and for example IH (induction heating) heater may be used. In addition, the fixing device of the present disclosure is not limited to a roller-type fixing device using a fixing roller, and a belt-type fixing device using a fixing belt may be used. In addition, the fixing device of the present disclosure can be also applied not only an image forming apparatus for carrying out a color printing, but also an image forming apparatus for carrying out a black-and-white printing. In addition, the fixing device of the present disclosure is not limited to a printer, and can be applied to a copying machine, a facsimile or a multifunction peripheral.

While specific embodiments of the fixing device and the image forming apparatus according to the present disclosure has been described with reference to the particular illustrative embodiments, the fixing device and the image forming apparatus according to the present disclosure is not to be restricted by the embodiments. It is to be appreciated that those skilled in the art can change or modify the embodiments without departing from the scope and spirit that the appended claims show.

What is claimed is:

1. A fixing device provided on the way of a conveying path of a recording medium, and configured to fix an image formed on the recording medium to the recording medium, the fixing device comprising:

a fixing member configured to rotate around a first axis, a pressing member configured to rotate around a second axis parallel to the first axis, a heat source configured to heat the fixing member, a nip forming mechanism configured to press the fixing member and the pressing member one another to form a nip part between the fixing member and the pressing member, a separating plate placed at a downstream side of the nip part in the conveying path of the recording medium, having a receiving surface, and make a front end side of the recording medium ejected from the nip part come into contact with the receiving surface to separate the recording medium from the fixing member and orient the recording medium to the conveying path, a detector configured to detect a bending or leaping up of the front end side of the recording medium ejected from the nip part, and an ejecting direction controller configured to change an ejecting direction of the recording medium ejected from the nip part based on a detection result of the detector, wherein, in the receiving surface, in a region closer to the nip part than a region with which the front end side of the recording medium ejected from the nip part comes contact in a normal operation time, a catch part having a recessed, projected or stepwise shape and configured to catch the front end part of the recording medium ejected from the nip part is formed.

2. The fixing device according to claim 1, wherein the catch part is formed in an edge part at a side close to the nip part in the receiving surface.

3. The fixing device according to claim 1, wherein each of the separating plate and the catch part extends in an extension direction of the first axis, and a dimension of each of the separating plate and the catch part in an extension direction of the first axis is not less than a dimension of a width of the recording medium.

4. The fixing device according to claim 1, wherein the detector radiates light toward a direction crossing a conveying path of the recording medium at a downstream side of the nip part, and detects a position in which the light reaches the recording medium ejected from the nip part, thereby detecting the bending or leaping up of the front end side of the recording medium ejected from the nip part.

5. The fixing device according to claim 1, wherein the ejecting direction controller controls the nip forming mechanism based on the detection result of the detector, and decreases force for pressing the fixing member and the pressing member one another, thereby changing the ejecting direction of the recording medium ejected from the nip part.

6. The fixing device according to claim 1, wherein the ejecting direction controller controls the heat source based on the detection result of the detector, and decreases a fixing temperature, thereby changing the ejecting direction of the recording medium ejected from the nip part.

7. An image forming apparatus comprising the fixing device according to claim 1.

* * * * *